US008733138B2

(12) United States Patent
Favier

(10) Patent No.: US 8,733,138 B2
(45) Date of Patent: May 27, 2014

(54) ANTITHEFT DEVICE FOR MERCHANDISE INCLUDING MEANS FOR THE PLACEMENT AND SIMPLIFIED REMOVAL THEREOF

(75) Inventor: Alain Favier, Nogent-sur-Marne (FR)

(73) Assignee: Exaqtworld, Joinville-le-Pont (FR)

( * ) Notice: Subject to any disclaimer, the term of this patent is extended or adjusted under 35 U.S.C. 154(b) by 85 days.

(21) Appl. No.: 13/255,721

(22) PCT Filed: Mar. 9, 2010

(86) PCT No.: PCT/FR2010/050400

§ 371 (c)(1),
(2), (4) Date: Oct. 4, 2011

(87) PCT Pub. No.: WO2010/103228

PCT Pub. Date: Sep. 16, 2010

(65) Prior Publication Data

US 2012/0011904 A1 Jan. 19, 2012

(30) Foreign Application Priority Data

Mar. 9, 2009 (FR) ..... 09 51453

(51) Int. Cl.
*E05B 65/00* (2006.01)

(52) U.S. Cl.
USPC ..... 70/57.1; 70/19; 70/58; 70/232

(58) Field of Classification Search
USPC ..... 70/18, 19, 57, 57.1, 58, 59, 60, 61, 232
See application file for complete search history.

(56) References Cited

U.S. PATENT DOCUMENTS 5,144,820 A * 9/1992 Holmgren ..... 70/57.1
5,655,392 A * 8/1997 Holmgren ..... 70/57.1
6,374,647 B1 * 4/2002 Holmgren ..... 70/57.1
8,035,518 B2 * 10/2011 Kolton et al. ..... 70/57.1
8,171,761 B2 * 5/2012 Kidd ..... 70/57.1
2004/0065126 A1 * 4/2004 Yang ..... 70/58
2005/0262904 A1 * 12/2005 Ling et al. ..... 70/58
2008/0061987 A1 3/2008 Kolton et al.
2012/0204608 A1 * 8/2012 Sayegh et al. ..... 70/19
2012/0304709 A1 * 12/2012 Mazzucchelli ..... 70/19

FOREIGN PATENT DOCUMENTS

WO 02/061222 A1 8/2002
WO 2005/035923 A1 4/2005
WO 2006/033123 A1 3/2006

OTHER PUBLICATIONS

International Search Report, dated Jun. 8, 2010, from corresponding PCT application.

* cited by examiner

*Primary Examiner* — Christopher Boswell
(74) *Attorney, Agent, or Firm* — Young & Thompson

(57) ABSTRACT

An antitheft device (1) to be attached to an item capable of being stolen and including a control portion (2) that is rotatable relative to an attaching portion (3), the attaching portion (3) including an attaching element (4) that is translatably movable with an unlocked position, for placing of the item into the device (1) and for removing same, and wherein the rotation of the control portion (2) relative to the attaching portion (3) translates the attaching element (4), and with a locked position for maintaining the device (1) on the item and wherein the rotation of the control portion (2) relative to the attaching part (3) does not translate the attaching element (4). The control portion (2) includes a transmission mechanism (15) with a controller for the torque applied to the control portion so that the locked position is achieved for a predetermined value of the torque of forces.

20 Claims, 4 Drawing Sheets

Figure 1A:
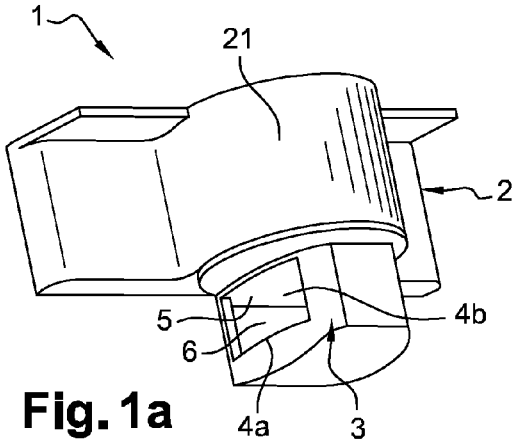

ANTITHEFT DEVICE FOR MERCHANDISE INCLUDING MEANS FOR THE PLACEMENT AND SIMPLIFIED REMOVAL THEREOF

This invention relates to an anti-theft device that is designed to be hooked onto an item that may be stolen, as well as an anti-theft system that is associated with it.

Certain kinds of noticeable products such as eyeglasses, golf clubs, bottles of alcohol, shoes, tennis rackets or else certain fragile textiles such as ribbons or silks require effective protection against theft from displays.

However, the existing anti-theft stickers or markings for the protection of this kind of product have often complex opening and closing systems, which are able in some cases to irreversibly damage the item for which they were intended to provide protection and sometimes require the use of bulky mechanical and/or electronic tools that are sometimes difficult to operate.

It is necessary to add to this that these anti-theft markings are often large in size and very heavy relative to the item to be protected. The purpose of this invention is to resolve all or a portion of the drawbacks of the state of the art.

For this purpose, the invention has as its object an anti-theft device that is designed to hook onto an item that can be pilfered, comprising a control part that can move in rotation relative to a hooking part, whereby said hooking part comprises hooking means that can move in translation with an unlocked position designed for the insertion of the item into the device and for its removal and in which the rotation of the control part relative to the hooking part drives the translational movement of the hooking means, and a locked position that is designed to keep the device in place on the item and in which the rotation of the control part relative to the hooking part does not drive the translational movement of the hooking means.

This arrangement makes possible a simplified securing of the item by eliminating the use of any equipment for its installation.

The locked position is reached automatically for a predetermined value of a torque force applied to the control part. Thus, the user who wants to lock the device on the item so as to prevent its removal exerts a torque force until reaching a predetermined value that depends on the device itself—in particular on the internal transmission system that connects the control part to the hooking means—and not on the user.

This predetermined value, once reached, by design of the above-mentioned internal system, leads to a predetermined force exerted by the hooking means of the device on the item. It then is no longer possible to transmit an additional force to the hooking means because the internal system no longer temporarily and locally connects the control part to the hooking means.

The internal system that connects the control part to the hooking means actually comprises, locally in the chain for transmitting forces, a connection part that is designed (sizing . . . ) for automatic interruption when the force that is applied to it exceeds a threshold value (like a mechanical fuse).

If the user continues to apply a torque force to the control part, force is no longer transmitted into the transmission chain because of the interrupted connection portion.

More particularly, the predetermined value of the torque force to be applied to the control part is defined during the design of the device and in particular during the design of the different pieces that constitute the internal system for transmitting force connecting the control part to the hooking means.

The device that is manufactured thus comprises in itself the adjustment of the control part to the predetermined value mentioned above.

According to one characteristic, the predetermined value is such that the force exerted by the hooking means of the device on the item is adjusted based on the item.

The sizing achieved during the design of the device is adapted to the nature or to the kind of item to be protected.

For the same kind of item, for example eyeglasses, the sizing is the same regardless of the model of the item.

Thus, the predetermined value of the torque force to be applied to the control part and the resulting force exerted on the item do not vary from one model to the next.

For example, regardless of the model of eyeglasses and in particular the thickness of the arms of the eyeglasses, the predetermined value of the torque force and the resulting force exerted on the item are the same.

A device can therefore be applied to the same kind or to the same nature of item. However, for an item of a different nature, for example a bottle, a preadjusted/differently sized device is to be used.

According to one characteristic, the force exerted on the item is sufficient to prevent a manual removal of the device from the item without, however, being too high so as not to damage the item.

This arrangement makes it possible to adjust the device on the item with suitable pressure so as, on the one hand, not to risk damaging it, for example, by scratching it or by crushing it, and so as, on the other hand, to exert an adequate pressure force on the item so that the removal of the device from the item is not easy.

According to one characteristic, the hooking part comprises a stationary portion against which the hooking means press the item into a locked position.

This arrangement makes it possible to secure fragile items without having to pierce them, contrary to what certain existing anti-theft devices do.

Thus, the hooking means move in translation for resting the item or a part of the latter against a stationary portion and for exerting on the latter a pressure or clamping force that is predetermined and suitable for preventing the device from separating from the item. This stationary portion acts as a stop.

For example, the pressure or clamping force is applied in one or more directions on one or more surfaces of the item or a part of the latter, and the movement of the latter in a direction that is perpendicular to the above-mentioned direction or directions is thus prevented.

According to one characteristic, the hooking part comprises a passage opening of the item in which the hooking means move in translation.

This passage opening can run through along an axis for insertion in the case of a golf club, eyeglasses, or tennis racket handles, but it may also not run through to make it possible to hook the device on items that cannot be inserted into a through opening, as is the case of textile products, for example.

According to another aspect, the shape of the opening is matched to the shape and the dimensions of the item on which the device is designed to be hooked.

This arrangement makes the device more reliable by eliminating the geometric insertion constraints and by eliminating the possibility for a thief to force the device through the opening by the insertion of a tool.

According to one characteristic, the stationary portion is defined by a wall or by one of the walls that delimits the opening.

Thus, if the opening is defined by a ring-shaped support, the stationary portion is defined by the inside surface of the ring.

According to one characteristic, the control part can move in rotation around an axis along which the hooking means are moved translationally.

Thus, the force exerted by the user is a rotational force. In practice, the user rotates an actuating element (example: button or wheel) that is integral with the control part.

According to one characteristic, a system that is internal to the device transforms the rotational movement into a translational movement.

The design of this transmission system defines the predetermined adjustment values of the torque and the force exerted on the item.

According to one characteristic, the control part has a contact surface for a user putting said control part into rotation, with the contact surface being located at a distance from the axis of rotation.

The distance between the axis of rotation and the contact or actuation surface defines a lever arm that makes it possible to gear down the clamping force to be exerted on the item starting from a predetermined torque force value to be applied for use on the control part.

For the user, this arrangement thus constitutes assistance in locking the device on an item.

Normal force on the user's part is adequate for exerting a clamping force on the item that normally would require the use of a tool and would call for a greater force.

According to one characteristic, the device is configured/designed so that the distance between the contact surface and the axis of rotation is such that the force exerted by the hooking means of the device on the item is produced for a reduced predetermined value of the torque force that is applied to the control part.

It should be noted that the actuation or gripping (actuating part) surface of the control part of certain devices can be sized to be relatively distant from the axis of rotation and thus to increase the lever arm effect. The object here is to reduce as much as possible the force that the user is to produce for locking the device.

In other cases, it is preferred to have a device that is as compact as possible, and therefore imparting excessive dimensions to the actuating part of the control part is prevented. This selection is preferred, for example, when the item is relatively small.

The selection between one and the other case may depend on the kind of item to be protected and can also or alternately be a matter of a compromise between ease of installation/compactness.

According to one embodiment, the control part comprises a casing that is integral with a drive wheel that encases a cam that moves in rotation and that is designed to drive—in a translational movement—the hooking means, a transmission mechanism that is designed to create a first mechanical connection between the casing and the cam in a preferred direction of rotation, and a clutch mechanism that is designed to create a second mechanical connection between the casing and the cam in the two directions of rotation.

According to the same embodiment, the transmission mechanism comprises an S-shaped part, integral with the cam and whose ends of the branches of the S can be deformed elastically in the plane of the S and in the sawtoothed shape on their outside contour, and a ring that is arranged opposite the casing and whose inside contour has a sawtoothed shape whose teeth have a shape that is complementary to those present at the ends of the S-shaped part and that have projecting elements that block the rotation of the ring in a direction of rotation by their interaction with elements that are integral with the casing.

According to the same aspect, the clutch mechanism comprises a pin that moves in translation inside a first housing provided in the cam and with a shape that is complementary to that of the contour of the pin; a return spring that is in rest position keeps the movable pin entirely inside this first housing and a second housing that is provided on the casing with a shape that is complementary to that of the contour of the pin.

Advantageously, identification or reference means, such as RFID, radiofrequency, acoustomagnetic or electromagnetic means, are placed in the control part that can move in rotation.

The geometry and the shape of the control part make it possible to accommodate any kind of anti-theft tracer or coil, thus making it compatible with any kind of technology in the sector of the industry for the electronic anti-theft prevention of items and traceability.

The invention also has as its object an anti-theft system that comprises an anti-theft device as described above and that comprises means for identification, means for unlocking the device making it possible to switch from the locked position to the unlocked position, and a means for detecting the identification means, such as a security portal.

The invention will be better understood using the following description, with reference to the accompanying schematic drawings that show, by way of nonlimiting examples, several embodiments of an anti-theft device according to the invention.

FIG. 1*a* is a perspective view of an anti-theft device according to a first embodiment of the invention.

Figure 1B:
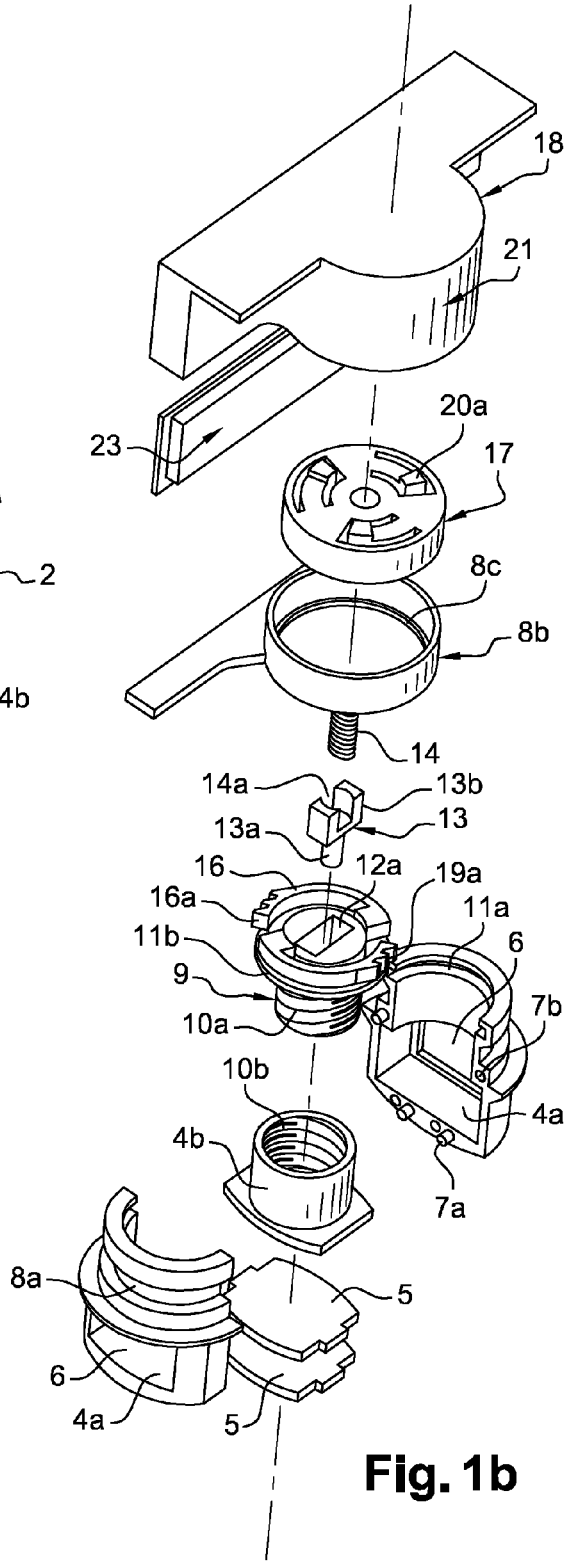

FIG. 1*b* is an exploded perspective view seen from the top of the anti-theft device that is illustrated in FIG. 1*a*.

Figure 2A:
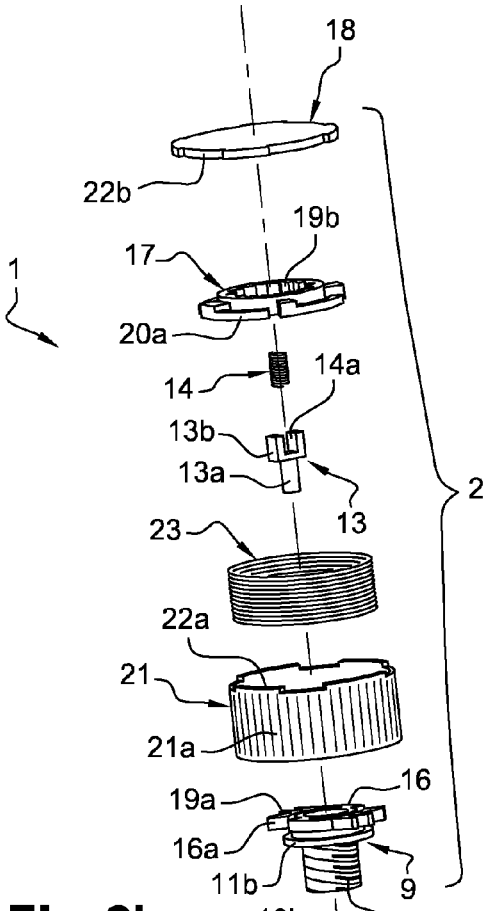
Figure 2A:
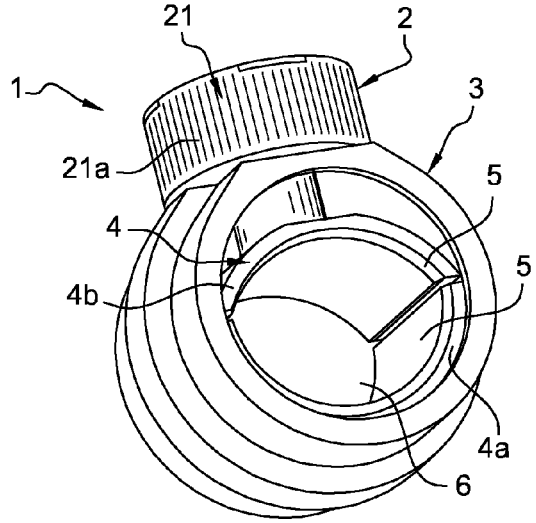

FIG. 2*a* is a perspective view of an anti-theft device according to a second embodiment of the invention.

Figure 2B:
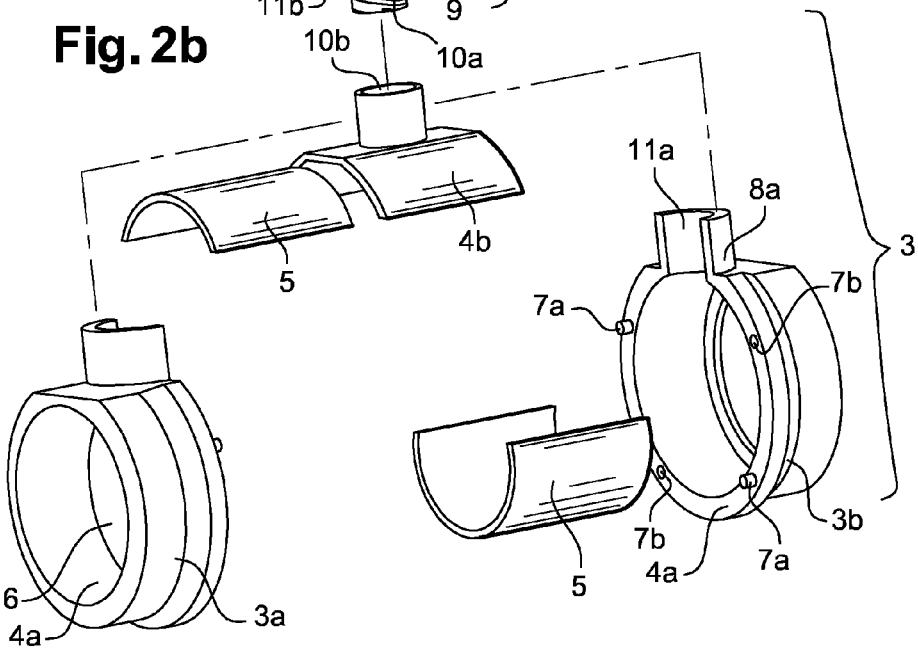

FIG. 2*b* is an exploded perspective view seen from the top of the anti-theft device illustrated in FIG. 2*a*.

Figure 3A:
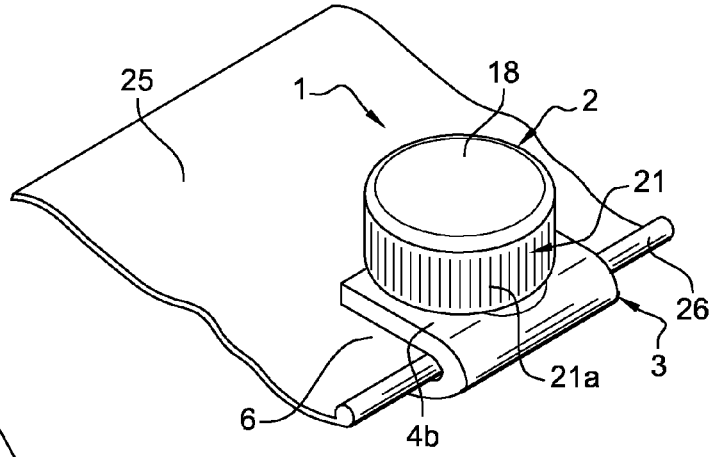

FIG. 3*a* is a perspective view of an anti-theft device in position according to a third embodiment of the invention.

Figure 3B:
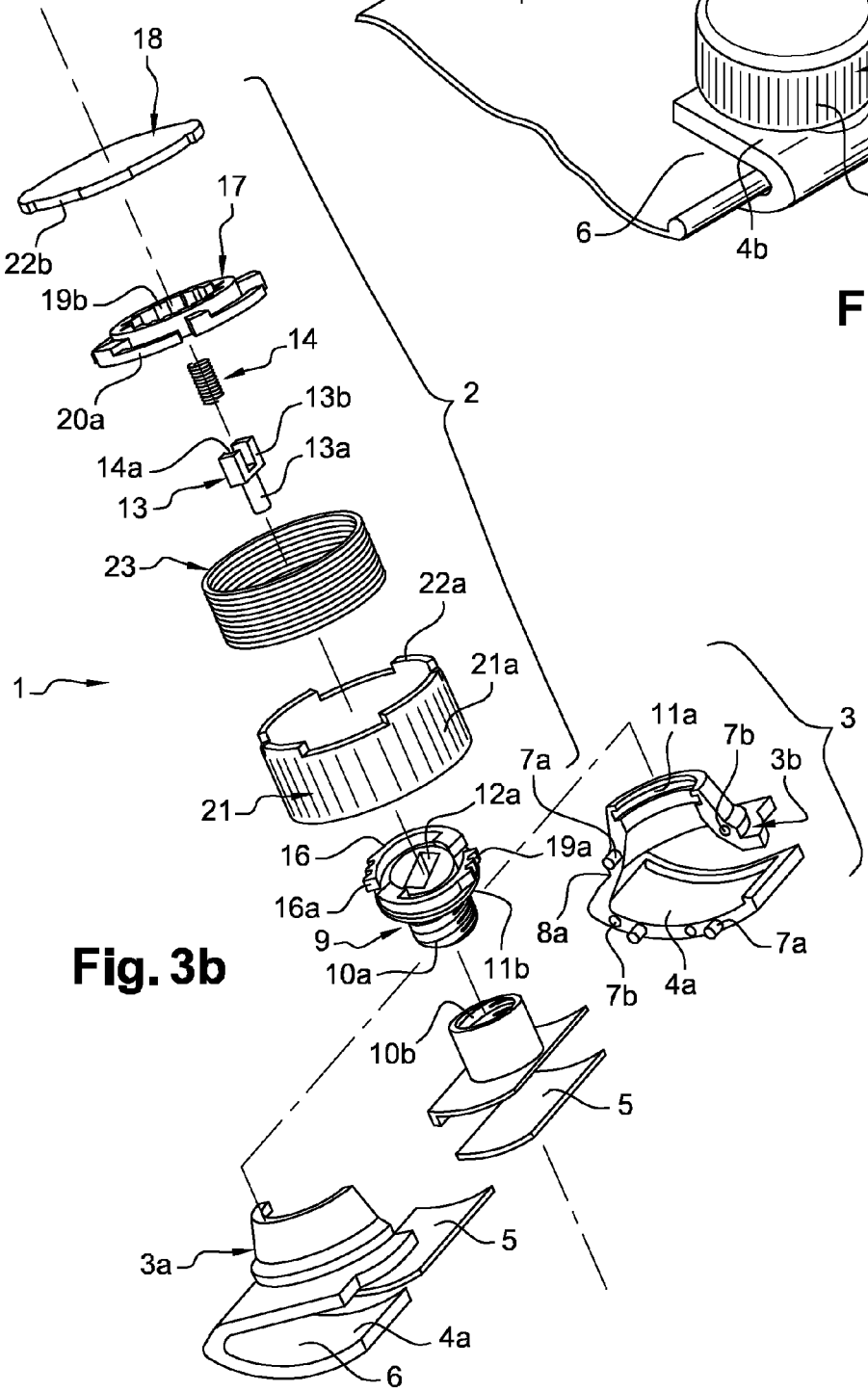

FIG. 3*b* is an exploded perspective view seen from the top of the anti-theft device illustrated in FIG. 3*a*.

Figure 4:
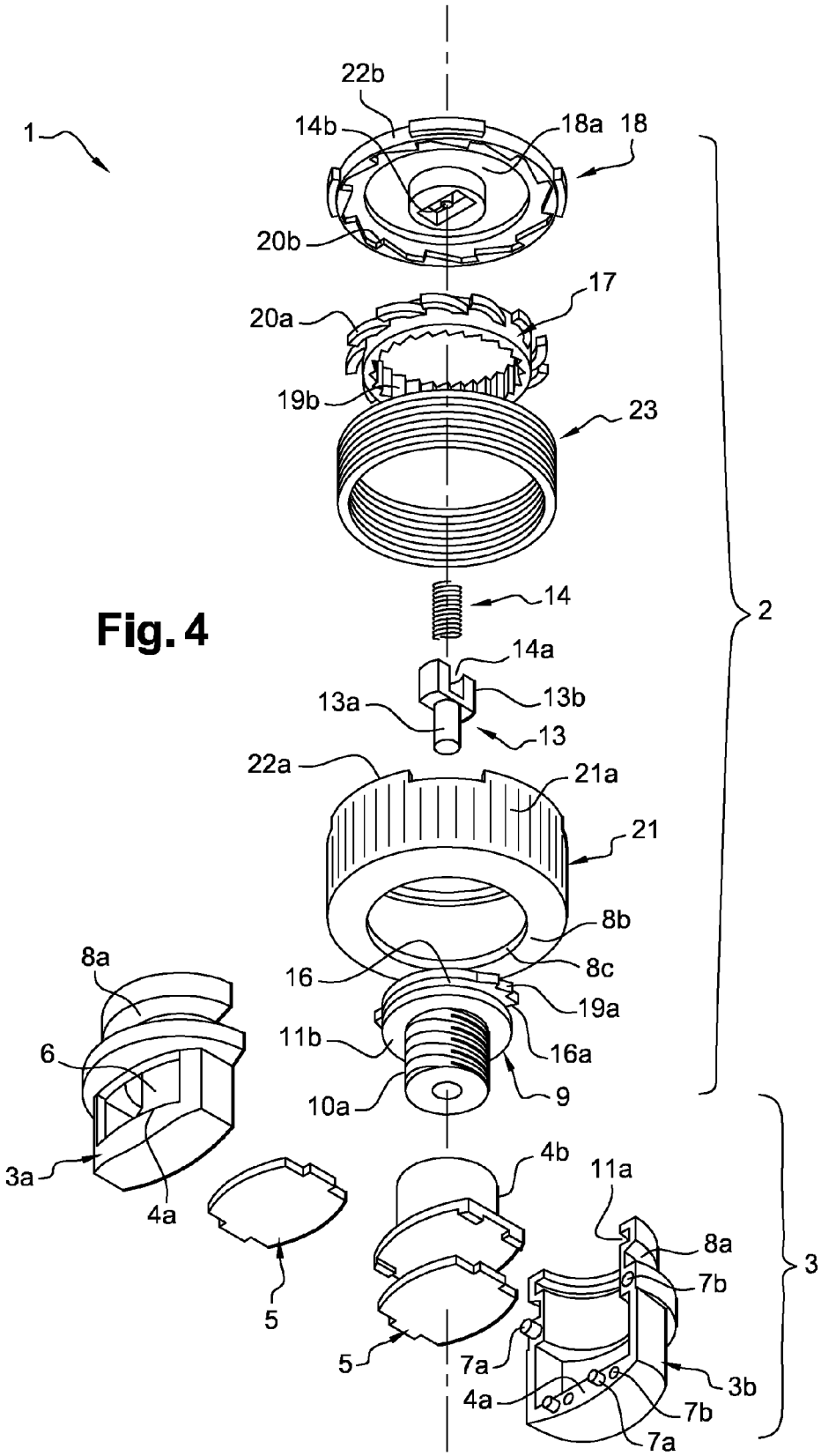

FIG. 4 is an exploded perspective view seen from the bottom of the anti-theft device according to a fourth embodiment.

According to FIGS. 1*a*, 2*a*, and 3*a*, an anti-theft device 1 according to the invention comprises a control part 2 and a hooking part 3.

The hooking part 3 has an opening 6 for inserting or removing the item to be protected. As each of these figures shows, this opening 6 can have several shapes according to the item to be secured.

The device of FIG. 1*a* ensures the securing of pairs of eyeglasses for the purpose of inserting one of the arms of the pair of eyeglasses through the opening 6.

By way of example, the device of FIG. 2*a* ensures the securing of golf clubs or tennis rackets by inserting their handles through the opening 6 or else necks of bottles of wine and alcohol.

The device of FIG. 3*a* ensures the securing of textile or fabric items 25 by inserting one of the edges 26 of the fabric 25 through the opening 6. This precludes having to pierce the fabric 25 with a nail, as is the case in numerous anti-theft devices of the state of the art.

As FIGS. 1*b*, 2*b*, 3*b*, or 4 show, the hooking part 3 of an anti-theft device 1 according to the invention is divided transversely into two half-portions or half-boxes 3*a* and 3*b*. These two half-portions 3*a* and 3*b* are made integral with one another, for example, using pins 7*a* that are arranged transversely projecting along the joint plane on one of the half-portions aligned with holes 7*b* arranged transversely along the joint plane on the other half-portion. This mechanical connection is maintained definitively by, for example, an ultrasound welding process.

Other systems for assembling half-portions can be considered.

These two half-portions 3*a* and 3*b* contain hooking means 4 that clamp the item to be protected when it is run into the opening 6.

These hooking means 4 comprise a stationary part 4*a* that consists of a wall that is formed by the joining of two half-portions 3*a* and 3*b*, and a part that moves in translation 4*b*. The part that moves in translation 4*b* comprises a hollow cylindrical portion 10*b* that is threaded on its inside as well as a flat portion 4*b*' with a rectangular shape that is located in a plane that transversely intersects the cylindrical portion 10*b* and that has a length and a width that are greater than the diameter of the cylindrical portion 10*b*.

The flat portion 4*b*' projects into the opening 6 in which it is held by a surface that is produced by the joining of the two half-portions 3*a* and 3*b* used as a rear stop for the flat portion 4*b*'.

The stationary part 4*a* and the movable part 4*b* with its flat portion 4*b*' are located opposite one another in the opening 6. The stationary part 4*a* can, moreover, be used as a front stop for the flat portion 4*b*' in the case where no item is run through the opening 6.

Rubber pieces 5 are bonded to the surfaces opposite the stationary part 4*a* and the flat portion 4*b*' of the movable part 4*b* so as to produce more adhesion to the anti-theft device 1 once the latter is locked on the item, but also so as to protect the item and the anti-theft device 1 itself during its clamping on the item.

As it is shown in FIGS. 1*b*, 2*b* and 3*b*, the control part 2 of an anti-theft device 1 according to the invention comprises, i.a., a cam 9 and a drive wheel 21 that ensures the mechanical connections with the hooking part 3. Actually, by being joined, the two half-portions 3*a*, 3*b* of the hooking part 3 form a first inside annular groove 11*a* and a second outside annular groove 8*a*.

The cam 9 of essentially cylindrical shape has a disk-shaped annular portion 11*b* and a threaded portion 10*a*. The annular portion 11*b* is designed to evolve into the first annular groove 11*a* of the hooking part 3 while the threaded portion is inserted into the hollow and threaded cylindrical portion 10*b* of the movable part 4*b* of the hooking means 4. This annular portion 11*b* is inserted into the inside annular groove 11*a* when the two half-portions 3*a*, 3*b* are joined.

It is understood here that a cam is a mechanical piece that transforms a rotational movement into a translational movement.

A holding piece 8*b* that comprises a circular portion having a lip 8*c* with a diameter that is approximately equal to that of the inside of the outside annular groove 8*a* is inserted in force into this same groove 8*a* on the hooking part 3. The holding piece 8*b* is thus held on the hooking part 3, also preventing the separation of the two half-portions 3*a*, 3*b*.

On its upper part, the cam 9 has a coaxial housing 12*a* that is designed to accommodate a pin 13 in its entirety.

The pin 13 is metal and on one of its two ends has a projecting element 13*a* that makes it possible to be arranged coaxially to an opening that runs through the cam 9 that is provided along its axis of rotation. On the other end of the pin 13, there is a rectangular portion 13*b* in which a housing 14*a* for accommodating a helical compression spring 14 is provided. Once the anti-theft device 1 is mounted, this spring 14 is at rest or else compressed between the housing 14*a* that is provided in the rectangular portion 13*b* of the pin 13 and another housing 14*b* that is provided on the casing 18 (on an inside surface) of the control part 2.

Coaxially to this housing 14*b*, another housing 12*b*—with a shape that is complementary to the rectangular shape of the rectangular portion 13*b* of the pin 13—is provided on an inside surface of the casing 18.

The unit that comprises the pin 13, the housing 12*a* on the cam 9, the housing 14*a* on the pin 13, the spring 14 and the housings 14*b* and 12*b* on the casing 18 constitutes a clutch mechanism (13, 12*a*, 14*a*, 14, 14*b*, 12*b*) for the anti-theft device 1.

Coaxially to this clutch mechanism (13, 12*a*, 14*a*, 14, 14*b*, 12*b*), a transmission mechanism with a torque monitor is arranged in the control part 2 of the anti-theft device 1.

This transmission mechanism comprises an S-shaped part 16 of the cam 9 that is provided on the latter, designed, for example, in one piece, and a ring 17 that is arranged between the cam 9 and the casing 18.

The two ends 16*a* of the S-shaped part 16 are flexible along the plane of the S and each have a sawtoothed portion 19*a*. The plane of the S is, in the examples described, perpendicular to the axis of rotation of the cam.

The ring 17 has, on its inside contour 19*b*, a sawtoothed shape whose teeth have a shape that is complementary to those of the portions 19*a*, and, on its inside surface, projecting elements 20*a*, for example, in the form of rectangular trapezoids arranged on flexible branches transversely to the plane of the ring 17. This configuration is illustrated in FIGS. 2*b* and 3*b*, but the projecting elements 20*a* can have another shape and can be arranged on the outside contour of the ring 17 as is illustrated in FIG. 4.

A housing 18*a* that is provided on the inside surface of the casing 18 allows the coaxial movement of the ring 17 with the S-shaped part 16 of the cam 9.

This movement is stopped in a direction of rotation by projecting elements 20*b*, themselves also of rectangular trapezoidal shape, provided on the casing 18 on the path of the rectangular trapezoidal projecting elements 20*a* that are arranged on the flexible branches of the ring 17.

The rectangular trapezoidal elements of the casing 18 and the ring 17 are arranged opposite such that the slopes of the two rectangular trapezoids come together in a direction of rotation, thus making it possible for the branches of the ring 17 to bend and for the ring to rotate, while in the other direction of rotation, the rectangular sides of the trapezoids come together, thus preventing the bending of the branches of the ring 17 and therefore the rotation of the latter.

Alternately, it should be noted that other elements attached to the ring 17, on the one hand, and to the casing 18 (inside surface), on the other hand, can perform the same engagement functions in one direction of rotation (the ring and the casing being linked in rotation) and rotation relative to one another in the opposite direction.

Finally, identification or reference means 23 are concealed inside the control part 2. These means can comprise an antenna as illustrated in FIGS. 2*b* and 2*c* or can be electromagnetic as illustrated in FIG. 1*b*. In this last example, it is shown that the drive wheel 21 can assume another shape, making it possible to adapt it to the means of identification or reference 23 that are used.

This wheel 21 is closed on its rear part by the casing 18. As illustrated in FIGS. 2*b*, 3*b* and 4, the wheel 21 comprises projecting parts 22*a* that have a complementary shape and recesses 22*b* that are arranged on the casing 18. This mechanical connection and therefore the access to the interior of the control part 2 are made unbreakable by, for example, an ultrasound welding process.

Grooves 21*a* are provided on the contour of the wheel 21 (contact or actuation surface) so as to facilitate gripping by the user.

It is also possible to add to the wheel 21 a display device (not shown) that has a display surface of a size that is larger than that of the wheel 21 and that enables the visualization of complementary information on the item that is protected by the anti-theft device 1 according to the invention.

Relative to the use of the device 1 according to the invention, during the installation of the device 1 on an item to be protected, the user begins by pushing the hooking means 4 as wide open as possible to make it possible to insert the item into the opening 6. In other words, the hooking means are moved so that they penetrate the interior of the opening as little as possible and thus release the free space in the opening for the passage of a part of the item in the latter. For this purpose, it rotates the wheel 21 in its direction of opening, and this movement drives in rotation the ring 17 in its locking direction. At the same time, the inside contour 19*b* of the ring 17, despite the non-locking position of the pairs of sawteeth of the inside contour 19*b* of the ring 17 and the S-shaped piece 16 arranged on the cam 9, nevertheless drives the latter. This movement is possible because in the absence of a force exerted on the movable part 4*b* of the hooking means 4, the flexibility of the branches of the S-shaped piece 16 arranged on the cam 9 is adequate for allowing the driving of the cam 9 and therefore the translational movement of the movable part 4*b* of the hooking means 4.

Once the item has passed into the opening 6, the user will rotate the wheel 21 in the direction of the closing of the hooking means 4, which will, in a first step, drive the ring 17 whose teeth of the inside contour 19*b* will block the teeth of the S-shaped piece 16 arranged on the cam 9, and then drive the cam 9 in rotation that, in its turn, drives the movable part 4*b* of the holding means 4 in a translational movement until it reaches the item.

Once the movable part of the hooking means is in contact with the item and for a predetermined torque value during the design of the device (torque of clamping forces applied by the user on the wheel), the ring 17 will enter into rotation in its running direction of rotation, opposite the blocking direction, thus making any additional attempt at clamping futile.

It should be noted that the predetermined value of the torque force is provided, in the described examples, by the force that is to be applied by the user during the clamping to release the projecting elements of the ring from the complementary projecting elements of the casing. The diameter of the drive wheel centered on the axis of rotation of the cam facilitates the clamping force that has to be applied by the user to exert a much greater clamping force on the item.

When the predetermined value of the torque force is reached by the user clamping the wheel of the control part, the hooking means exert a clamping force on the item that is predetermined by the design of the device and that is suitable for the item. This clamping force is determined by sizing all of the components of the internal system for the transmission of movement that was just described.

The item is thus locked with the anti-theft device and therefore secured. The reference means 23 that are concealed in the control part 2 of the anti-theft device 1 according to the invention will trigger an alarm when the item passes close to a security portal.

Once secured, the unclamping of the anti-theft device 1 from the item will not be possible because, in the unclamping direction of the wheel 21, the flexibility of the branches of the S-shaped piece 16 arranged on the cam 9 is too great to oppose the torque exerted during clamping. The branches of the S-shaped piece 16 arranged on the cam 9 will therefore bend primarily radially, i.e., in the plane of the S, without any movement being transmitted to the hooking means 4.

The only way to release the item from the anti-theft device 1 according to the invention consists in engaging the wheel 21 with the cam 9 by means of the clutch mechanism (13, 12*a*, 14*a*, 14, 14*b*, 12*b*).

To do this, the user has to arrange a powerful neodymium-type magnet against the outside surface of the casing 18 so as to remove the metal pin 13 from its housing 12*a* and to draw it against the inside surface of the casing 18 against the compression force of the spring 14.

At the same time, the user has to rotate the wheel 21 in the direction that creates the opening of the hooking means 4. For a certain position of the wheel 21, the rectangular portion 13*b* of the metal pin 13 will penetrate the housing 12*b* that has a rectangular shape that is complementary to the casing 18. The rotation of the wheel 21 will then directly drive the rotation of the cam 9 by means of the pin 13 whose rectangular part 13*b* will be arranged partially in the housing 12*a* of the cam 9 and partially in the housing 12*b* of the casing 18.

Once the anti-theft device 1 is separated from the item, the user removes the magnet, and the spring 14 extends, driving the pin 13 in the interior of its housing 12*a* into the cam 9.

The device 1 is thus ready for a new use.

As is evident, the invention is not limited to just the embodiments of this device 1, described above by way of examples, but on the contrary it covers all of the variants. The pin 13 can, for example, have any shape except circular, the housings 12*a* and 12*b* having to have a shape that can drive the pin 13 in rotation.

It should be noted, moreover, in a nonlimiting way, that the control part can have a different shape with one or more gripping elements with different shapes and sizes.

In addition, the internal system for transmission of the rotational movement produced by the user and for transformation into a movement of axial displacement of the hooking means can be different.

The elements that constitute this system and that are linked to one another should be able to transmit a force that makes it possible to move the hooking means to a certain force value from which the connection between two of the elements that work together is interrupted.

For example, it may involve a release or disconnection of two pieces from one another when the torque force that is applied exceeds a predetermined value applied during the manufacture.

By way of example, the force exerted by a user on the device of FIGS. 2*a* and 2*b* is 22.05 N, the radius of the wheel 21 is 1.27 cm, and the torque force that is produced is 28 Ncm. The resulting clamping force that is applied by the device to the item is approximately 200 N.

The force that is exerted by a user on the device of FIGS. 1*a* and 1*b*, to provide the same torque force of 28 Ncm and to produce the same clamping force of 200 N, is reduced relative to the one that is indicated above because of the larger lever arm. Actually, the wheel 21 comprises two portions that extend from the central casing 18 in opposite directions so as to increase the distance between the actuation surface that is offered to the user and the axis of rotation that is embodied in FIG. 1*b*. The drive wheel has, for example, the general shape of a hammer head, which makes gripping easy. The distance between a free end of one of the two portions and the axis is, for example, 2.35 cm, which makes it necessary, on the user's part, to develop a force of only 11.92 N.

The invention claim is:

1. An anti-theft device that is designed to hook onto an item that can be pilfered, comprising:

a control part that can move in rotation relative to a hooking part, whereby said hooking part comprises hooking means that can move in translation with:

an unlocked position designed for the insertion of the item into the device and for its removal and in which the rotation of the control part relative to the hooking part drives the translational movement of the hooking means, and a locked position that is designed to keep the device in place on the item and in which the rotation of the control part relative to the hooking part does not drive the translational movement of the hooking means, wherein the locked position is achieved for a predetermined value of a torque force that is applied on the control part, the predetermined value being predetermined during design of the device, wherein the control part has an external contact surface at which a user causes the control part to be rotated without the use of a tool to cause a clamping force to be exerted on the item, and wherein the device further comprises an internal system that connects the control part to the hooking means, said internal system comprising a connection part that is inherently designed for automatic interruption when a torque force that is applied by the hand of the user on the external contact surface of the control part exceeds said predetermined value.

2. The anti-theft device according to claim 1, wherein the predetermined value is such that the force that is exerted by the means for hooking the device on the item is adjusted based on the item.

3. The anti-theft device according to claim 2, wherein the force that is exerted on the item is enough to prevent a manual removal of the device from the item without, however, being too high so as not to damage the item.

4. The anti-theft device according to claim 1, wherein the hooking part comprises a stationary portion against which the hooking means press the item into a locked position.

5. The anti-theft device according to claim 4, wherein the hooking part comprises a passage opening of the item in which the hooking means move in translation.

6. The anti-theft device according to claim 5, wherein the shape of the opening is adapted to the shape and sizes of the item on which the opening is designed to hook.

7. The anti-theft device according to claim 5, wherein the stationary portion is defined by a wall that delimits the opening.

8. The anti-theft device according to claim 1, wherein the control part can move in rotation around an axis along which the hooking means are moved translationally.

9. The anti-theft device according to claim 8, wherein a system internal to the device transforms the rotational movement into a translational movement.

10. The anti-theft device according to claim 8, wherein the contact surface of the control part is located at a distance from the axis of rotation.

11. The anti-theft device according to claim 10, wherein it is configured so that the distance between the contact surface and the axis of rotation is such that the force exerted by the means for hooking the device on the item is achieved for a small predetermined value of the torque force applied on the control part.

12. The anti-theft device according to claim 1, wherein the control part comprises a casing that is integral with a drive wheel that encases:

a cam that can move in rotation and that is designed to drive the hooking means in a translational movement, a transmission mechanism with a torque monitor that is designed to create a first mechanical connection between the casing and the cam in a preferred direction of rotation, and a clutch mechanism that is designed to create a second mechanical connection between the casing and the cam in the two directions of rotation.

13. The anti-theft device according to claim 12, wherein the transmission mechanism with the torque monitor comprises:

an S-shaped part, integral with the cam and whose ends of the branches of the S can be deformed elastically in the plane of the S and have a sawtoothed shape on their outside contour, a ring that is arranged opposite the casing and whose inside contour has a sawtoothed shape whose teeth have a shape that is complementary to those present at the ends of the S-shaped part and that have projecting elements that block the rotation of the ring in a direction of rotation by their interaction with elements that are integral with the casing.

14. The anti-theft device according to claim 12, wherein the clutch mechanism comprises:

a pin that moves in translation inside a first housing that is provided in the cam and with a shape that is complementary to that of the contour of the pin, a return spring that in rest position keeps the movable pin entirely inside this first housing, and a second housing that is provided on the casing with a shape that is complementary to that of the contour of the pin.

15. The anti-theft device according to claim 1, wherein an identification or reference means are placed in the control part that can move in rotation.

16. The anti-theft system that comprises:

an anti-theft device according to claim 15, an unlocking means that makes it possible to switch from the locked position to the unlocked position, and a means for detecting identification means.

17. The anti-theft device according to claim 1, wherein the control part comprises an external drive wheel.

18. The anti-theft device according to claim 17, wherein the external drive wheel comprises an external contact surface with grooves facilitating gripping by the user.

19. An anti-theft device that is designed to hook onto an item that can be pilfered, comprising:

a control part that can move in rotation relative to a hooking part, whereby said hooking part comprises hooking means that can move in translation with:

an unlocked position designed for the insertion of the item into the device and for its removal and in which the rotation of the control part relative to the hooking part drives the translational movement of the hooking means, and a locked position that is designed to keep the device in place on the item and in which the rotation of the control part relative to the hooking part does not drive the translational movement of the hooking means, wherein the locked position is achieved for a predetermined value of a torque force that is applied on the control part, wherein the control part comprises a casing that is integral with a drive wheel that encases:

a cam that can move in rotation and that is designed to drive the hooking means in a translational movement, a transmission mechanism with a torque monitor that is designed to create a first mechanical connection between the casing and the cam in a preferred direction of rotation, and a clutch mechanism that is designed to create a second mechanical connection between the casing and the cam in the two directions of rotation, and wherein the transmission mechanism with the torque monitor comprises:

an S-shaped part, integral with the cam and whose ends of the branches of the S can be deformed elastically in the plane of the S and have a sawtoothed shape on their outside contour, a ring that is arranged opposite the casing and whose inside contour has a sawtoothed shape whose teeth have a shape that is complementary to those present at the ends of the S-shaped part and that have projecting elements that block the rotation of the ring in a direction of rotation by their interaction with elements that are integral with the casing.

20. An anti-theft device that is designed to hook onto an item that can be pilfered, comprising:

a control part that can move in rotation relative to a hooking part, whereby said hooking part comprises hooking means that can move in translation with:

an unlocked position designed for the insertion of the item into the device and for its removal and in which the rotation of the control part relative to the hooking part drives the translational movement of the hooking means, and a locked position that is designed to keep the device in place on the item and in which the rotation of the control part relative to the hooking part does not drive the translational movement of the hooking means, wherein the locked position is achieved for a predetermined value of a torque force that is applied on the control part, wherein the control part comprises a casing that is integral with a drive wheel that encases:

a cam that can move in rotation and that is designed to drive the hooking means in a translational movement, a transmission mechanism with a torque monitor that is designed to create a first mechanical connection between the casing and the cam in a preferred direction of rotation, and a clutch mechanism that is designed to create a second mechanical connection between the casing and the cam in the two directions of rotation, and wherein the clutch mechanism comprises:

a pin that moves in translation inside a first housing that is provided in the cam and with a shape that is complementary to that of the contour of the pin, a return spring that in rest position keeps the movable pin entirely inside this first housing, and a second housing that is provided on the casing with a shape that is complementary to that of the contour of the pin.

* * * * *